US009238934B2

(12) United States Patent
Booi et al.

(10) Patent No.: US 9,238,934 B2
(45) Date of Patent: Jan. 19, 2016

(54) DOOR JAMB MEMBER, DOOR JAMB ASSEMBLY INCORPORATING SAME AND KIT THEREFOR

(71) Applicants: Arie Booi, Ingleview (CA); Oded Eddy Rochman, Thornhill (CA)

(72) Inventors: Arie Booi, Ingleview (CA); Oded Eddy Rochman, Thornhill (CA)

( * ) Notice: Subject to any disclaimer, the term of this patent is extended or adjusted under 35 U.S.C. 154(b) by 0 days.

(21) Appl. No.: 13/908,369

(22) Filed: Jun. 3, 2013

(65) Prior Publication Data

US 2014/0102017 A1 Apr. 17, 2014

Related U.S. Application Data

(60) Provisional application No. 61/713,834, filed on Oct. 15, 2012.

(51) Int. Cl.

| | |
|---|---|
| ***E06B 1/04*** | (2006.01) |
| ***E06B 1/52*** | (2006.01) |
| ***E06B 1/56*** | (2006.01) |
| ***E06B 3/964*** | (2006.01) |
| *E06B 1/26* | (2006.01) |
| *E06B 1/32* | (2006.01) |
| *E06B 1/34* | (2006.01) |

(52) U.S. Cl.

CPC . *E06B 1/52* (2013.01); *E06B 1/342* (2013.01); *E06B 1/56* (2013.01); *E06B 3/9641* (2013.01); *E06B 3/9642* (2013.01); *E06B 1/26* (2013.01); *E06B 1/32* (2013.01); *E06B 1/34* (2013.01)

(58) Field of Classification Search

CPC ..... E06B 1/04; E06B 1/32; E06B 1/52; E06B 1/56; E06B 3/9641; E06B 1/342; E06B 3/9642

USPC ..... 52/210, 211, 717.01, 656.4, 656.1, 52/204.1, 658

See application file for complete search history.

(56) References Cited

U.S. PATENT DOCUMENTS

| | | | | |
|---|---|---|---|---|
| 3,875,713 | A * | 4/1975 | Laborde | 52/288.1 |
| 5,378,077 | A * | 1/1995 | Paulsen | 403/402 |
| 5,758,458 | A * | 6/1998 | Ridge | 52/204.1 |
| 5,941,033 | A * | 8/1999 | Adams | 52/212 |
| 6,148,582 | A * | 11/2000 | Ellingson | 52/656.4 |
| 6,155,011 | A * | 12/2000 | Robertson | 52/212 |
| 6,295,779 | B1 * | 10/2001 | Canfield | 52/656.4 |
| 6,568,137 | B2 * | 5/2003 | Ballantyne | 52/211 |
| 6,604,334 | B2 * | 8/2003 | Rochman | 52/717.01 |
| 6,966,158 | B1 * | 11/2005 | Christensen | 52/213 |
| 7,043,883 | B1 * | 5/2006 | Cederberg et al. | 52/204.1 |
| 7,228,663 | B2 * | 6/2007 | Schiedegger et al. | 52/211 |
| 7,472,519 | B2 * | 1/2009 | Careri | 52/210 |
| 7,533,503 | B2 * | 5/2009 | Wang | 52/217 |
| 7,971,400 | B2 * | 7/2011 | Boldt et al. | 52/204.1 |
| 8,484,913 | B2 * | 7/2013 | Charbonneau | 52/210 |

(Continued)

*Primary Examiner* — Adriana Figueroa
*Assistant Examiner* — Jessie Fonseca
(74) *Attorney, Agent, or Firm* — The Farrell Law Firm, P.C.

(57) ABSTRACT

A door jamb assembly comprises a plurality of longitudinal door jamb portions. Each door jamb portion comprises a longitudinal door jamb member comprising a longitudinal rounded channel and a plurality of longitudinal internal cavities, and a longitudinal frame member comprising a rounded longitudinal edge matingly engaging the rounded channel of the door jamb member. The door jamb assembly also comprises a plurality of corner keys forming generally right-angled joints between adjacent door jamb portions.

13 Claims, 8 Drawing Sheets

(56) References Cited

U.S. PATENT DOCUMENTS

| | | | | |
|---|---|---|---|---|
| 2002/0069604 | A1* | 6/2002 | Canfield | 52/656.4 |
| 2002/0083663 | A1* | 7/2002 | Ballantyne | 52/204.1 |
| 2002/0166299 | A1* | 11/2002 | Day | 52/211 |
| 2004/0182040 | A1* | 9/2004 | Schiedegger et al. | 52/717.01 |
| 2005/0223661 | A1* | 10/2005 | Hetherington et al. | 52/204.1 |
| 2006/0123719 | A1* | 6/2006 | Careri | 52/204.5 |
| 2007/0022699 | A1* | 2/2007 | Wang | 52/656.4 |
| 2008/0034702 | A1* | 2/2008 | Garries et al. | 52/656.2 |
| 2008/0072506 | A1* | 3/2008 | LeGoff | 52/204.1 |
| 2008/0178541 | A1* | 7/2008 | Kerscher et al. | 52/204.1 |
| 2013/0219813 | A1* | 8/2013 | Gadoury | 52/211 |
| 2013/0263536 | A1* | 10/2013 | Peck et al. | 52/211 |

* cited by examiner

DOOR JAMB MEMBER, DOOR JAMB ASSEMBLY INCORPORATING SAME AND KIT THEREFOR

CROSS-REFERENCE TO RELATED APPLICATIONS

This application claims the benefit of U.S. Application Ser. No. 61/713,834 entitled "DOOR JAMB ASSEMBLY" filed on Oct. 15, 2012, the content of which is incorporated herein by reference in its entirety.

FIELD OF THE INVENTION

The present invention relates generally to door jambs and in particular, to a door jamb member, a door jamb assembly incorporating the same and a kit therefor.

BACKGROUND OF THE INVENTION

Doorways of dwellings and other buildings are often constructed by installing wooden side plates and a wooden top plate around a doorway. Wooden casings are frequently attached to the edges of the side and top plates. Lock set recesses and hinges are then added to opposite side plates.

As will be appreciated, this approach requires considerable handiwork and the exercise of some degree of skill. It also requires on site labour, and is typically time-consuming. Additionally, this approach also does not provide for weather proofing, and in some cases weather proofing is improvised by attaching weather stripping around the edges of the doorway.

To facilitate doorway construction, it may be desirable and more cost-effective to utilize a pre-fabricated door jamb comprising inexpensive structural materials such as plastic. Door jambs comprising extruded plastic have been previously described. For example, U.S. Pat. No. 6,557,309 to Johnson discloses a door jamb assembly having an interchangeable multi-component design allowing for the framing of doorways with different configurations by first selecting a main frame and a decorative trim that conforms with the doorway, and then securing a first end of the main frame, being attached to the decorative trim, onto a wall with the use of an attachment flange and securing a second end of the main frame to an interior jamb with the use of a fastener.

U.S. Pat. No. 7,472,519 to Careri discloses a plastic door jamb member for forming a portion of a door jamb, the plastic member having a recess for receiving a wooden door jamb portion, and an interlocking attachment recess for interconnection with a metal reinforcement plate. The plastic door jamb member may be interengaged with the wooden door jamb portion, and further interengaged with the metal reinforcement plate, and installed in position as a combination door jamb assembly.

Improvements are generally desired. It is therefore an object at least to provide a novel door jamb member, door jamb assembly incorporating same, and kit therefor.

SUMMARY OF THE INVENTION

In one aspect, there is provided a door jamb assembly, comprising: a plurality of longitudinal door jamb portions, each door jamb portion comprising: a longitudinal door jamb member comprising a longitudinal rounded channel and a plurality of longitudinal internal cavities, and a longitudinal frame member comprising a rounded longitudinal edge matingly engaging the rounded channel of the door jamb member; and a plurality of corner keys forming generally right-angled joints between adjacent door jamb portions.

Each corner key may have a plurality of pins extending therefrom matingly engaging the internal cavities of two adjacent door jamb members for forming a generally right-angled joint between two adjacent door jamb portions.

The door jamb member may further comprise a longitudinal clip disposed adjacent the rounded channel and engaging a longitudinal groove adjacent the rounded longitudinal edge of the frame member. The door jamb member may further comprise a first channel for accommodating weather stripping. The door jamb member may further comprise a second channel for accommodating exterior trim. The door jamb member may further comprise a third channel for accommodating a reinforcement member.

The door jamb member may be extruded or pulltruded. The door jamb member may be fabricated of extruded polyvinyl chloride (PVC). The door jamb member may be fabricated of extruded PVC cap stock.

Each corner key may be injection molded. Each corner key may comprise a first panel and a second panel, the first and second panels each having pins extending therefrom. The first and second panels may be oriented generally orthogonally to each other.

The rounded channel and the internal cavities may extend the length of the door jamb member. The rounded longitudinal edge may extend the length of the frame member.

In another aspect, there is provided a longitudinal door jamb member for use in a door jamb assembly, the door jamb member comprising: a rounded channel for receiving a rounded longitudinal edge of a longitudinal frame member; and a plurality of longitudinal internal cavities, each internal cavity being configured for receiving a pin of a corner key.

The door jamb member may further comprise a longitudinal clip disposed adjacent the rounded channel for engaging a corresponding longitudinal groove of the frame member. The door jamb member may further comprise a first channel for accommodating weather stripping. The door jamb member may further comprise a second channel for accommodating exterior trim. The door jamb member may further comprise a third channel for accommodating a reinforcement member.

The door jamb member may be extruded or pulltruded. The door jamb member may be fabricated of extruded PVC. The door jamb member may be fabricated of extruded PVC cap stock.

The rounded channel and the internal cavities may extend the length of the door jamb member.

In another aspect there is provided a kit for a door jamb assembly, comprising: a plurality of longitudinal door jamb portions, each door jamb portion comprising: a longitudinal door jamb member comprising a longitudinal rounded channel and a plurality of longitudinal internal cavities, and a longitudinal frame member comprising a rounded longitudinal edge configured for matingly engaging the rounded channel of the door jamb member; and a plurality of corner keys configured for forming generally right-angled joints between adjacent door jamb portions.

Each corner key may have a plurality of pins extending therefrom for matingly engaging the internal cavities of two adjacent door jamb members, each corner key being configured for forming a generally right-angled joint between two adjacent door jamb portions.

At least one door jamb member may be one or more of (i) separate from, and (ii) unsecured to, its corresponding frame member.

The frame member may further comprise a longitudinal groove adjacent the rounded longitudinal edge, wherein the door jamb member further comprises a longitudinal clip disposed adjacent the rounded channel configured for engaging the groove. The door jamb member may further comprise a first channel configured for accommodating weather stripping. The door jamb member may further comprise a second channel configured for accommodating exterior trim. The door jamb member may further comprise a third channel configured for accommodating a reinforcement member.

The door jamb member may be extruded or pulltruded. The door jamb member may be fabricated of extruded PVC. The door jamb member may be fabricated of extruded PVC cap stock.

Each corner key may be injection molded. Each corner key may comprise a first panel and a second panel, the first and second panels each having pins extending therefrom. The first and second panels may be oriented generally orthogonally to each other.

The rounded channel and the internal cavities may extend the length of the door jamb member. The rounded longitudinal edge may extend the length of the frame member.

BRIEF DESCRIPTION OF THE DRAWINGS

Embodiments will now be described more fully with reference to the accompanying drawings in which.

DETAILED DESCRIPTION OF THE EMBODIMENTS

Figure 1:
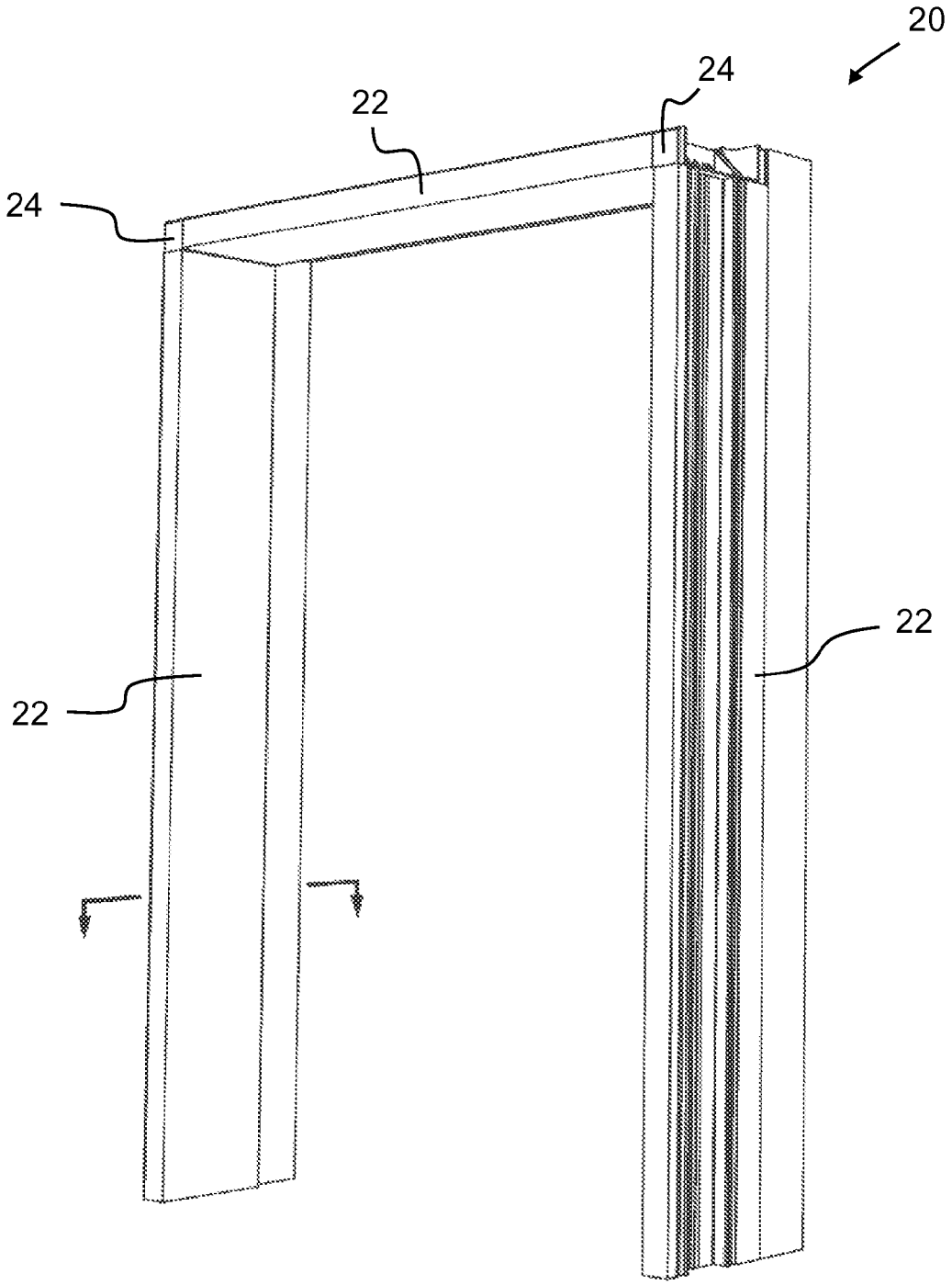
FIG. 1 is a perspective view of a door jamb assembly.
Figure 2A:
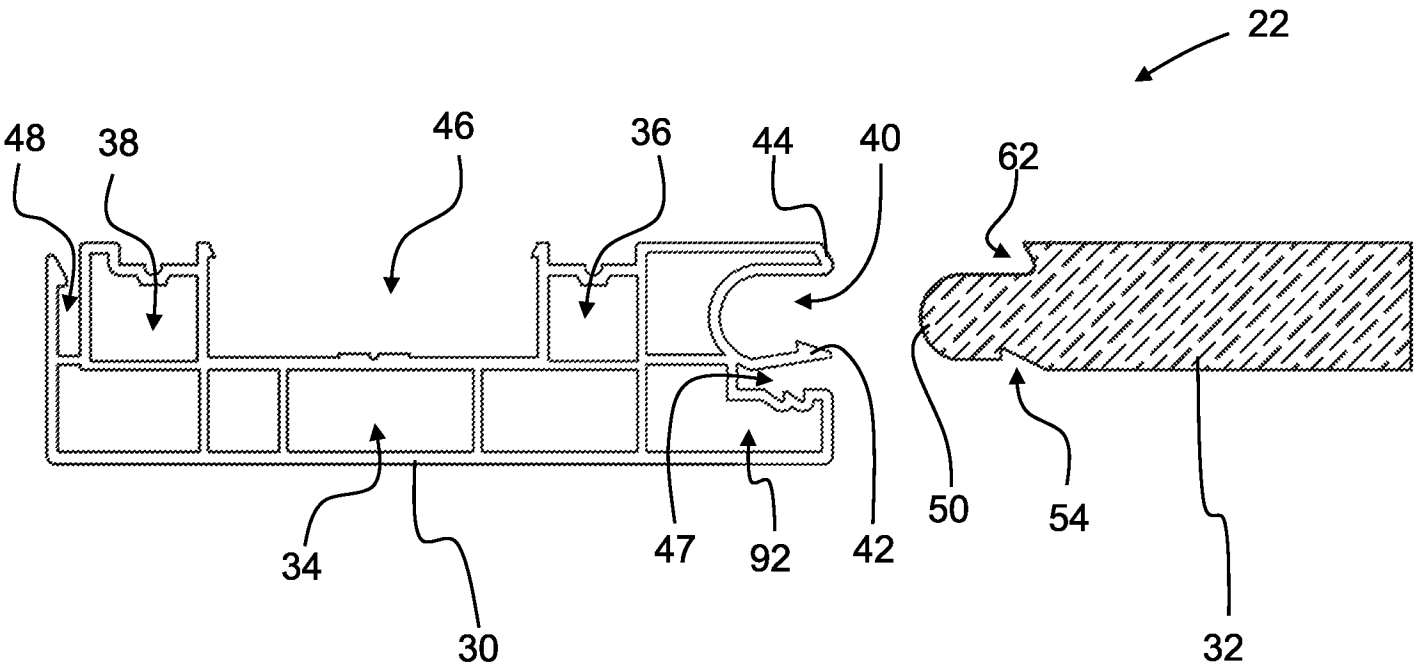
FIGS. 2*a* and 2*b* are exploded sectional and sectional views, respectively, of a door jamb portion forming part of the door jamb assembly of FIG. 1, and taken along the indicated section line.
Figure 2B:
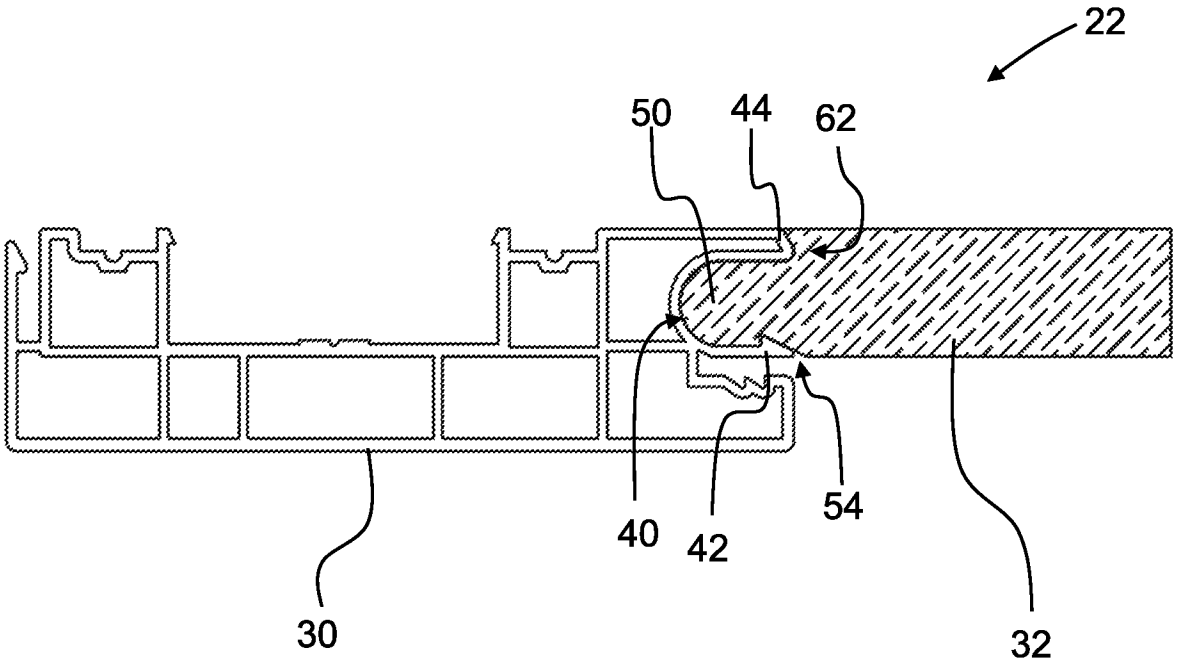

Turning now to FIG. 1, a door jamb assembly is shown and is generally indicated by reference numeral 20. Door jamb assembly 20 is configured to be installed in a doorway (not shown) for providing a door jamb for a door (not shown). The door jamb assembly 20 comprises three (3) door jamb portions 22 that are connected by two (2) corner keys 24.

The door jamb portion 22 may be better seen in FIGS. 2 to 5. Each door jamb portion 22 comprises an extruded, longitudinal door jamb member 30 and a longitudinal frame member 32. In this embodiment, the door jamb member 30 is fabricated of polyvinyl chloride (PVC) "cap stock", and is formed by co-extrusion of recycled (or "regrind") PVC and new PVC so as to provide a body of recycled PVC that is coated with layer of new PVC, as is known in the art. The door jamb member 30 has a plurality of longitudinal internal cavities formed therein, which extend the length of the door jamb member 30 and which are separated by longitudinal internal webs. In the embodiment shown, the door jamb member 30 comprises a first internal cavity 34, a second internal cavity 36 and a third internal cavity 38.

The door jamb member 30 also has a plurality of longitudinal channels formed therein that extend the length of the door jamb member 30. In the embodiment shown, the door jamb member 30 comprises a rounded channel 40 that extends the length of the door jamb member 30, and which is configured to engage the frame member 32 as described below. The door jamb member 30 further comprises a biased, longitudinal clip 42 disposed along a first side of the rounded channel 40, and a longitudinal rib 44 disposed along a second side of the rounded channel 40. Additionally, the door jamb member 30 comprises a channel 46 that is sized and shaped for accommodating a longitudinal reinforcement member (not shown) having a corresponding profile. The door jamb member 30 further comprises a channel 47 that is sized and configured to accommodate weather stripping, and a channel 48 that is configured to accommodate trim surrounding the exterior of the doorway.

In this embodiment, each frame member 32 is formed by machining a longitudinal wooden board. In the embodiment shown, the frame member 32 comprises a rounded longitudinal edge 50, a longitudinal groove 52 disposed along a first side of the rounded longitudinal edge 50, and a longitudinal notch 62 disposed along a second side of the rounded longitudinal edge 50.

The rounded longitudinal edge 50 of the frame member 32 and the rounded channel 40 of the door jamb member 30 are configured to matingly engage so as to form a "bullnose" joint therebetween. When engaged in this manner, the longitudinal rib 44 matingly engages the longitudinal notch 62, and maintains the door jamb member 30 and the frame member 32 in a parallel relationship. Additionally, when engaged in this manner, the biased, longitudinal clip 42 engages the longitudinal groove 52 so as to secure the frame member 32 and the door jamb member 30 to each other. In this embodiment, the frame member 32 and the door jamb member 30 are further secured to each other by glue disposed between the rounded longitudinal edge 50 and the rounded channel 40.

Figure 3:
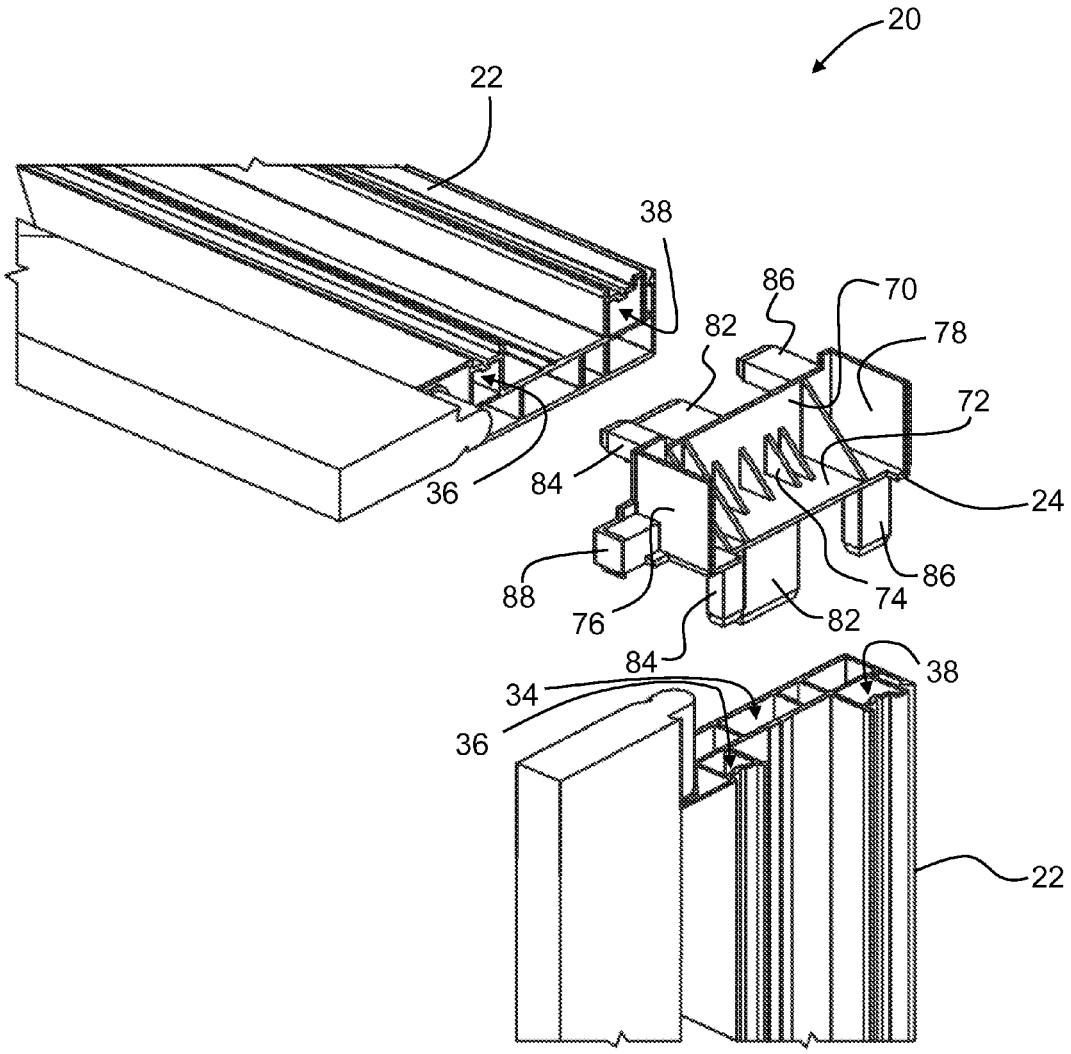
FIG. 3 is an exploded, upper perspective view of a portion of the door jamb assembly of FIG. 1.
Figure 4:
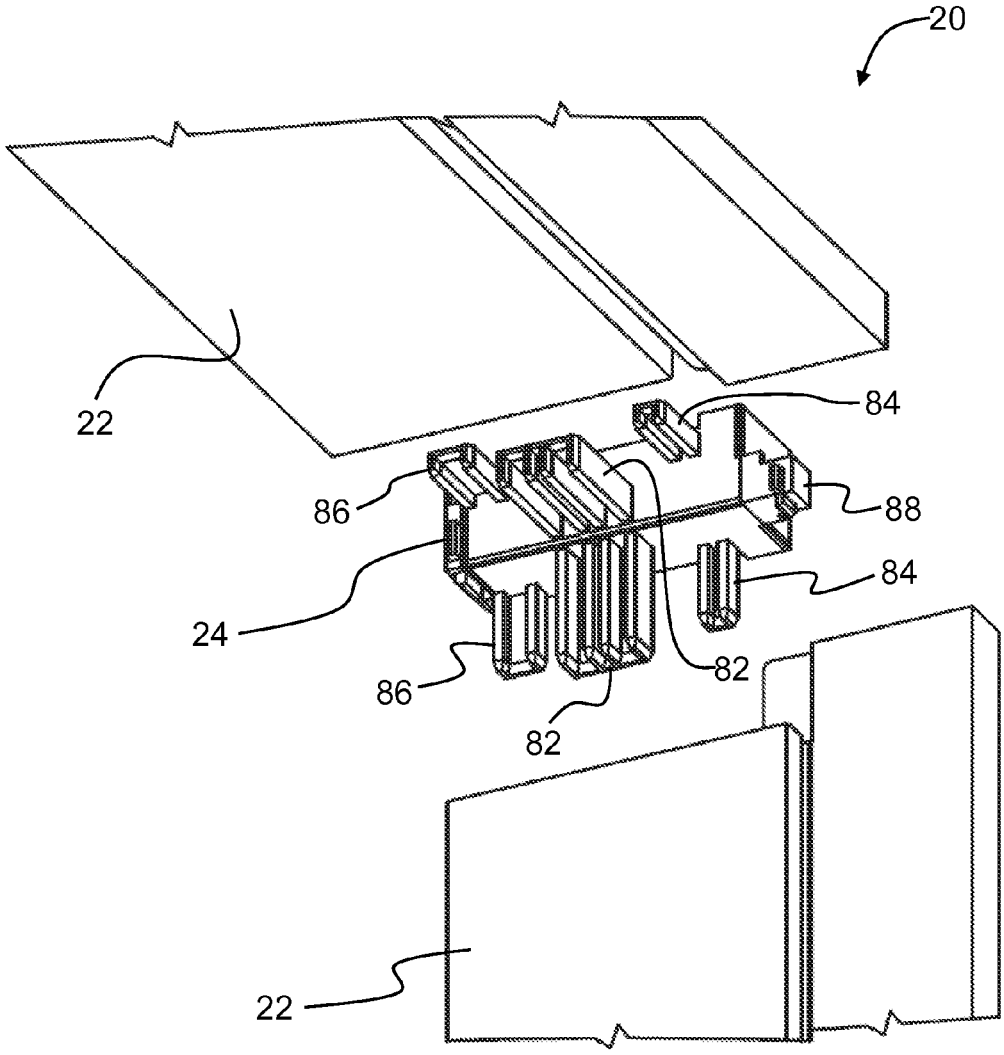
FIG. 4 is an exploded, lower perspective view of the portion of the door jamb assembly of FIG. 1.
Figure 5:
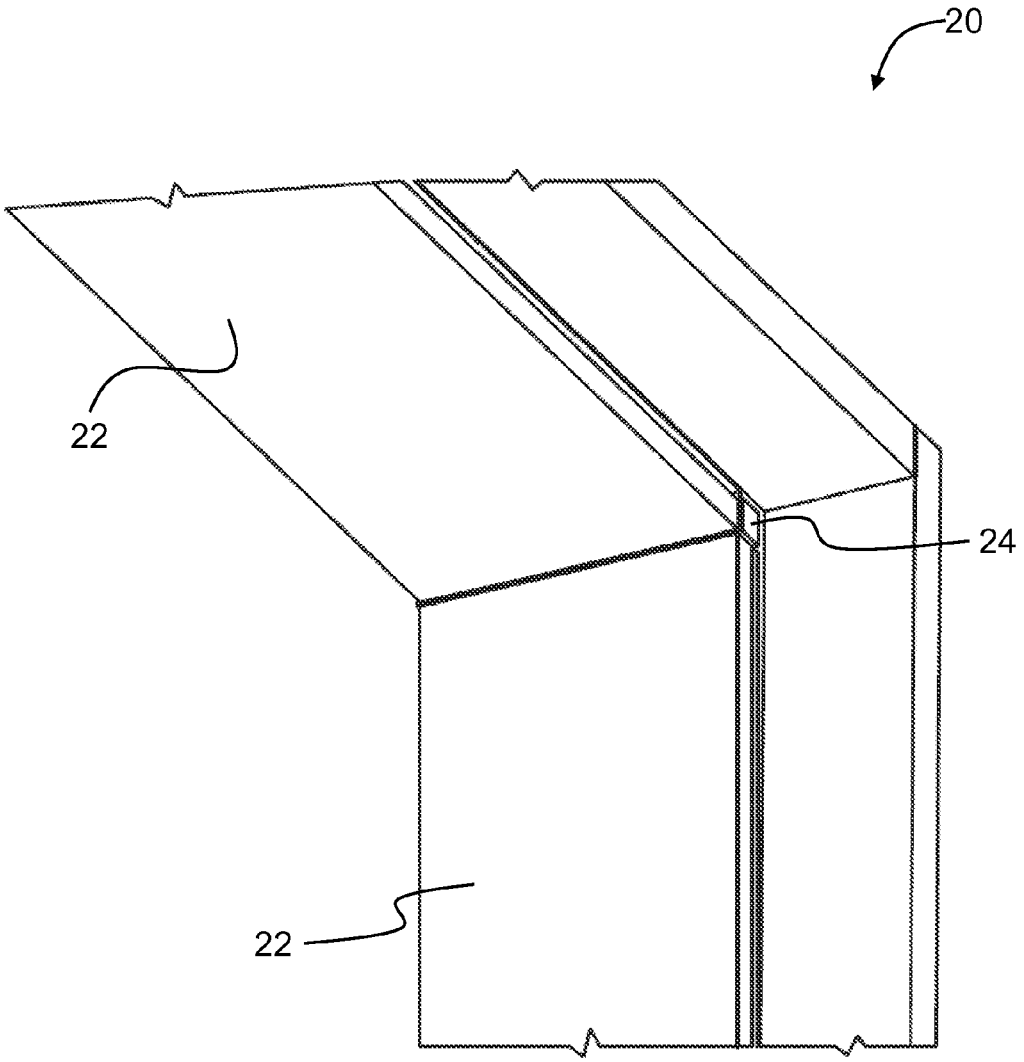
FIG. 5 is a lower perspective view of the portion of the door jamb assembly of FIG. 1.

The corner key 24 may be better seen in FIGS. 3 and 4. Each corner key 24 is a discrete and separate part from the door jamb portion 22. In this embodiment, each corner key 24 is fabricated of glass-filled nylon by injection molding. Each corner key 24 is generally shaped to engage the internal cavities 34, 36 and 38 of two (2) door jamb members 30, so as to form a generally 90 degree, or a generally "right-angled", joint between two (2) door jamb portions 22. Each corner key 24 comprises a first panel 70 and a second panel 72 that are connected along a common edge, and which are oriented generally orthogonally to each other. The first and second panels 70 and 72 are supported in relation to each other by gussets 74, and by a first end panel 76 and a second end panel 78. A set of pins extends outwardly from each of the first and second panels 70 and 72. In the embodiment shown, each set of pins comprises a first pin 82, a second pin 84 and a third pin 86 extending from each of the first and second panels 70 and 72, and which are sized and positioned to engage the first internal cavity 34, the second internal cavity 36 and the third internal cavity 38, respectively, of the door jamb member 30. The corner key 24 further comprises a cap pin 88 extending from the first end panel 76, which is sized and positioned to cover the channels 54 and interior cavities 92, when the corner key 24 connects the two (2) door jamb portions 22.

In use, the door jamb assembly 20 is assembled by providing two (2) corner keys 24 and three (3) door jamb portions 22, and namely two (2) door jamb portions 22 having a first length and one (1) door jamb portion 22 having a second length, the first length being greater than the second length. In this embodiment, each door jamb portion 22 is provided with the door jamb member 30 already secured to the frame member 32. Each end of the door jamb portion 22 having the second length is then connected to a corresponding end of a door jamb portion 22 having the first length using a corner key 24. In particular, adjacent door jamb portions 22 are connected by inserting a first pin 82, a second pin 84 and a third pin 86 of the corner key 24 into the first internal cavity 34, the second internal cavity 36 and the third internal cavity 38, respectively, of each adjacent door jamb portion 22. Once assembled, the assembled door jamb assembly may then be installed in a suitably-sized doorway opening in a wall, such that the one (1) door jamb portion 22 having the second length is oriented generally horizontally and the two (2) door jamb portions 22 having the first length are oriented generally vertically.

Figure 6:
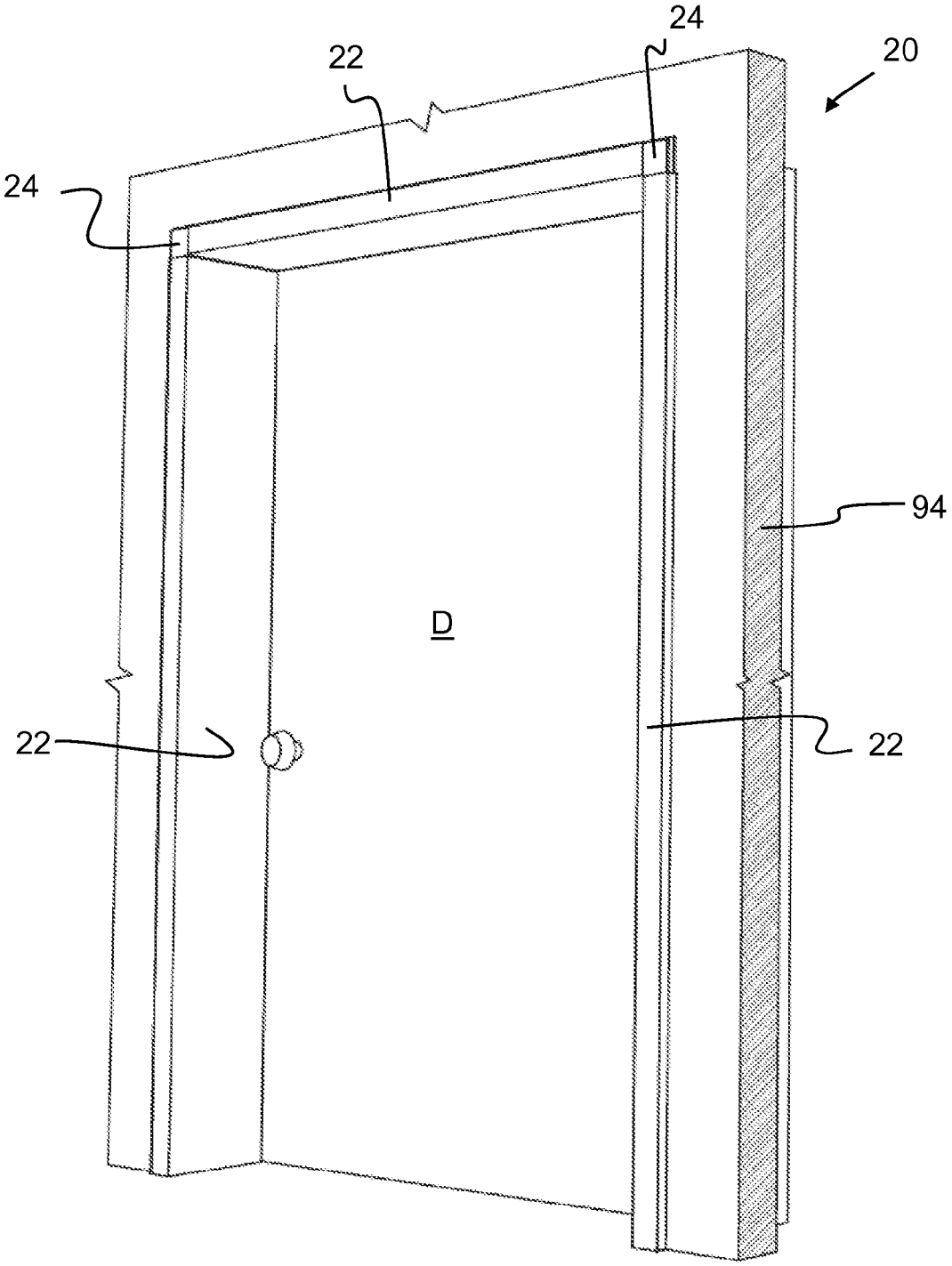
FIG. 6 is a perspective view of the door jamb assembly of FIG. 1, installed in a doorway.

FIG. 6 shows the door jamb assembly 20 installed in a doorway opening of a wall 94. Hinges (not shown) and lock set recesses (not shown) have been added to the frame members of the vertically-oriented door jamb portions 22 to support a door D.

Figure 7:
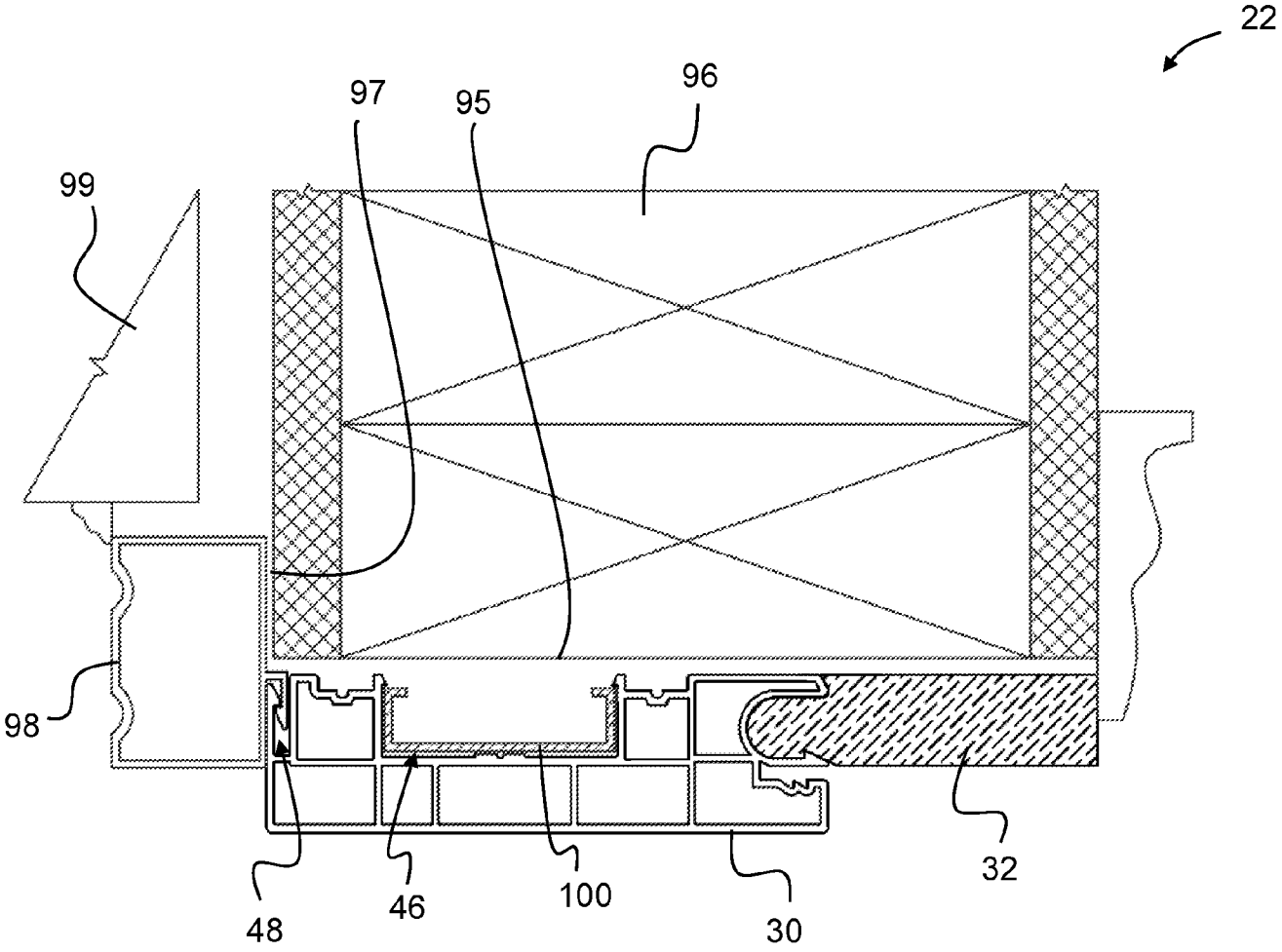
FIG. 7 is a sectional view of the door jamb portion of the door jamb assembly of FIG. 1, installed in another embodiment of a doorway and having brick mold fitted thereto.

FIG. 7 shows the door jamb portion 22 of the door jamb assembly 20 installed in another embodiment of a doorway opening of an exterior wall, such as for example an exterior wall of a house. As may be seen, the door jamb member 30 and the frame member 32 are positioned generally adjacent an inner surface 95 of a frame 96 surrounding the doorway opening. As may be seen, trim in the form of a brick mold 98 is accommodated by the longitudinal channel 48, for generally finishing the joint between the door jamb portion 22 and an exterior surface 97 of the doorway frame 96 and a surface of an exterior brick wall 99. Additionally, in the embodiment shown, a reinforcement member in the form of a bar 100 having a "C"-shaped cross-sectional profile is accommodated by the channel 46, for generally providing reinforcement to the door jamb portion 22.

As will be appreciated, the "bullnose" joint formed between the rounded longitudinal edge 50 of the frame member 32 and the rounded channel 40 of the door jamb member 30 is strong, and is simple in design and may advantageously be fabricated at a low cost. Moreover, the inherent strength of the "bullnose" joint advantageously eliminates the need for additional fasteners between the door jamb member 30 and the frame member 32, such as for example screws. Additionally, the rounded longitudinal edge 50 can advantageously be formed in a facile manner, and without forming burrs or surface roughness that might otherwise occur during formation of non-rounded edges by machining. As will be understood, the absence of burrs or surface roughness advantageously ensures a secure fit between the rounded channel 40 and the rounded longitudinal edge 50. Additionally, and as will be understood, the rounded longitudinal edge 50 does not have longitudinal corners or edges that would otherwise be likely to tear or chip upon insertion into a receiving channel of a member fabricated of non-wooden material.

As will be appreciated, the corner key 24 is configured to join two (2) door jamb portions 22 without requiring the ends of the door jamb portions 22 to be cut to a specific angle, other than the 90 degree angle formed during manufacture of the door jamb member 30. As will be appreciated, this eliminates the need to modify the ends of the door jamb portions 22, such as for example by cutting an end to a 45 degree angle by mitre saw, during on site assembly of the door jamb assembly 20. This allows the door jamb assembly 20 to be assembled from "stock" or unmodified parts, which advantageously reduces the cost of assembly of the door jamb assembly 20, and which advantageously allows parts that may have been damaged during transport or during assembly to be easily replaced.

Although in the embodiment described above, the door jamb assembly comprises two (2) door jamb portions having a first length and one (1) door jamb portion having a second length, where the first length being greater than the second length, in other embodiments, other configurations are possible depending on the dimensions of the doorway. For example, in other embodiments, the first length may alternatively be less than the second length, or the door jamb assembly may alternatively comprise three (3) door jamb portions having the same length.

Although in the embodiments described above, each door jamb portion is provided with the door jamb member already secured to the frame member, in other embodiments, for at least one door jamb member, the door jamb member and the frame member may alternatively be cut on site to a suitable size, and then secured to each other on site to provide the door jamb member.

Although in embodiments described above, the door jamb member is fabricated of polyvinyl chloride (PVC) "cap stock", in other embodiments, the door jamb member may alternatively be fabricated of virgin PVC, recycled PVC, or of any other suitable extrudable polymer. In still other embodiments, the door jamb member may alternatively be fabricated of extruded aluminum, extruded aluminum alloy, or pultruded fiberglass composite.

Although in embodiments described above, each frame member is formed by machining a longitudinal wooden board, in other embodiments, each frame member may alternatively be formed by machining a longitudinal board of another material, such as for example, plywood, medium-density fibreboard (MDF), particle board, PVC, foamed PVC, or a PVC composite material comprising one or more of wood, flour and rice.

Although in embodiments described above, the corner key is fabricated of glass-filled nylon by injection molding, it will be understood that the corner key need not be limited to this material or fabrication method, and in other embodiments may alternatively be fabricated of any suitable material by any suitable fabrication method.

It will be understood that the cross-sectional profile of the door jamb member is not limited to that of the embodiment described above, and in other embodiments, the door jamb member may alternatively have a different cross-sectional profile. For example, the door jamb member may alternatively have a different configuration of longitudinal internal cavities and longitudinal channels. As an example, in other embodiments, the position of the longitudinal channel that is configured to accommodate trim surrounding the exterior of the door may alternatively positioned at another suitable position of the door jamb member, such as on an adjacent side of the door jamb member. It will also be understood that the cross-sectional profile of the frame member is not limited to that of the embodiment described above, and in other embodiments, the frame member may alternatively have a different cross-sectional profile.

Although in embodiments described above, the door jamb assembly comprises three (3) door jamb portions that are connected by two (2) corner keys, in other embodiments, the door jamb assembly may alternatively comprise a greater number of door jamb portions and corner keys. For example, in one embodiment, the door jamb assembly may alternatively comprise four (4) door jamb portions that are connected by four (4) corner keys, with one of the door jamb portions serving as a sill in the assembled door jamb assembly.

Although in embodiments described above, the longitudinal internal cavities and the longitudinal channels of the door jamb member extend the length of the door jamb member, in other embodiments, at least one of the longitudinal internal cavities and/or at least one of the longitudinal channels may alternatively not extend the length of the door jamb member.

The invention also contemplates a kit of parts which, when assembled, forms the door jamb assembly of one or more of the embodiments described above.

Although embodiments have been described above with reference to the accompanying drawings, those of skill in the art will appreciate that variations and modifications may be made without departing from the scope thereof as defined by the appended claims.

What is claimed is:

1. A door jamb assembly, comprising:

a plurality of longitudinal door jamb portions, each door jamb portion comprising:

a longitudinal door jamb member comprising a longitudinal rounded channel and plurality of longitudinal internal cavities, and a longitudinal frame member comprising a rounded longitudinal edge matingly engaging the rounded channel of the door jamb member; and a plurality of corner keys, each corner key forming a generally right-angled joint between two of said doorjamb portions, a portion of each corner key being external to both said door jamb portions joined within said generally right-angled joint, wherein each corner key has a plurality of pins extending therefrom matingly engaging the internal cavities of the door jamb members for forming the generally right-angled joint, the generally right-angled joint defining a generally right angle about an axis, the plurality of pins being spaced along the axis, wherein each frame member has a greater length than the doorjamb member to which it is matingly engaged, and wherein each corner key further comprises a cap pin extending therefrom substantially parallel to the axis of the respective corner key, the cap pin being sized to be generally commensurate with a portion of the frame member extending beyond an end of the doorjamb portion to which the respective corner key is matingly engaged so as to cover an end of the respective door jamb portion.

2. The door jamb assembly of claim 1, wherein each door jamb member further comprises a longitudinal clip disposed adjacent the rounded channel and engaging a longitudinal groove adjacent the rounded longitudinal edge of the frame member engaged thereto.

3. The door jamb assembly of claim 1, wherein each door jamb member further comprises a first channel for accommodating weather stripping.

4. The door jamb assembly of claim 1, wherein each door jamb member further comprises a second channel for accommodating exterior trim.

5. The door jamb assembly of claim 1, wherein each door jamb member further comprises a third channel for accommodating a reinforcement member.

6. The door jamb assembly of claim 1, wherein each door jamb member is extruded or pulltruded.

7. The door jamb assembly of claim 6, wherein each door jamb member is fabricated of extruded polyvinyl chloride (PVC) cap stock.

8. The door jamb assembly of claim 1, wherein each corner key is injection molded.

9. The door jamb assembly of claim 1, wherein each corner key comprises a first panel and a second panel, the first and second panels each having pins extending therefrom.

10. The door jamb assembly of claim 1, wherein the rounded channel and the internal cavities extend the length of each door jamb member.

11. The door jamb assembly of claim 1, wherein the rounded longitudinal edge extends the length of each frame member.

12. A kit for a door jamb assembly, comprising:

a plurality of longitudinal door jamb portions, each door jamb portion comprising:

a longitudinal door jamb member comprising a longitudinal rounded channel and a plurality of longitudinal internal cavities, and a longitudinal frame member comprising a rounded longitudinal edge configured for matingly engaging the rounded channel of the door jamb member; and a plurality of corner keys, each corner key configured to form a generally right-angled joint between two of said door jamb portions, each corner key having a portion external to both said door jamb portions joined within said generally right-angled joint, wherein each corner key has a plurality of pins extending therefrom configured for matingly engaging the internal cavities of the door jamb members for forming the generally right-angled joint, the generally right-angled joint defining a generally right angle about an axis, the plurality of pins being spaced along the axis, wherein each frame member has a greater length than the doorjamb member to which it is to be matingly engaged, and wherein each corner key further comprises a cap pin extending therefrom substantially parallel to the axis of the respective corner key, the cap pin being sized to be generally commensurate with a portion of the frame member extending beyond an end of the door lamb portion to which the respective corner key is to be matingly engaged so as to cover an end of the respective door jamb portion.

13. The kit of claim 12, wherein at least one of said door jamb members is one or more of (i) separate from, and (ii) unsecured to, one said frame member.

* * * * *